US005632207A

United States Patent [19]

Roberts et al.

[11] Patent Number: 5,632,207

[45] Date of Patent: May 27, 1997

[54] CONVEYING SYSTEM

[75] Inventors: Charles Roberts; Donald Swallow, both of Evansville; Randall Wire, Boonville, all of Ind.

[73] Assignee: Evana Automation, Evansville, Ind.

[21] Appl. No.: 385,636

[22] Filed: Feb. 8, 1995

Related U.S. Application Data

[63] Continuation-in-part of Ser. No. 153,036, Nov. 17, 1993, Pat. No. 5,421,268.

[51] Int. Cl.[6] ..... B60L 5/00

[52] U.S. Cl. ..... 104/288; 104/118; 104/252; 104/295; 105/30; 105/33

[58] Field of Search ..... 104/287, 288, 104/295, 296, 252, 118; 105/26.05, 27, 30, 33

[56] References Cited

U.S. PATENT DOCUMENTS

| | | | |
|---|---|---|---|
| 381,384 | 5/1888 | Brown | 104/306 |
| 2,029,923 | 2/1936 | Herbert | 104/279 |
| 3,118,393 | 1/1964 | Ohlin | 104/166 |
| 3,246,609 | 4/1966 | Westfall | 105/30 |
| 3,356,040 | 12/1967 | Fonden | 104/166 |
| 3,498,236 | 3/1970 | Meek | 105/30 |
| 3,858,626 | 1/1975 | Ridordy | 104/166 |
| 3,858,707 | 1/1975 | Block et al. | 104/166 |
| 3,911,827 | 10/1975 | Tarnaker | 105/29.1 |
| 4,023,503 | 5/1977 | Grop | 105/30 |
| 4,355,581 | 10/1982 | Mitani | 104/166 |
| 4,487,132 | 12/1984 | Fuchs et al. | 104/166 |
| 4,941,555 | 7/1990 | Antunes | 104/295 |
| 4,951,574 | 8/1990 | Tsuneda | 104/288 |
| 4,974,519 | 12/1990 | Miletto | 104/165 |
| 5,037,045 | 8/1991 | Wakabayashi | 104/299 |
| 5,211,115 | 5/1993 | Maier et al. | 104/249 |
| 5,331,900 | 7/1994 | Gersemsky | 105/30 |
| 5,419,260 | 5/1995 | Hamilton | 105/30 |
| 5,450,796 | 9/1995 | Sakagami | 104/288 |

FOREIGN PATENT DOCUMENTS

| | | | |
|---|---|---|---|
| 620179 | 10/1994 | European Pat. Off. | 105/30 |
| 0663134 | 7/1938 | Germany | 104/306 |
| 2544072 | 4/1976 | Germany | 105/30 |
| 4205858 | 9/1993 | Germany | 105/30 |
| 4339073 | 11/1992 | Japan | 104/306 |

*Primary Examiner*—Mark T. Le
*Attorney, Agent, or Firm*—Larson and Taylor

[57] ABSTRACT

A conveying system is provided for moving a pallet along straight and curved paths. The conveying system includes a track on which the pallet is mounted for movement by a motor driven roller which engages a stationary shaft mounted on the track. The drive roller is urged into contact with the shaft and is capable of clockwise and counterclockwise rotation in order to effectuate forward or reverse motion of the pallet. A control device is provided for controlling the speed and stopping and starting the pallet. The control device may include object detectors and/or switches for stopping the pallet in response to objects on the track or for stopping the pallet at predetermined locations.

13 Claims, 2 Drawing Sheets

CONVEYING SYSTEM

BACKGROUND OF THE INVENTION

This application is a continuation-in-part of U.S. patent application Ser. No. 08/153,036, filed on Nov. 17, 1993, now U.S. Pat. No. 5,421,268 the contents of which are hereby incorporated by reference.

FIELD OF THE INVENTION

The present invention relates generally to a conveying system which moves a pallet along a path which may be straight or curvilinear. More particularly, the present invention relates to a conveying system in which propulsion for the pallet is provided by a rotating drive roller in contact with a stationary shaft.

PRIOR ART

Conveying systems utilizing a rotating drive shaft and a contacting drive wheel have been disclosed in the prior art. Typical of such devices are those disclosed in U.S. Pat. Nos. 3,356,040; 3,118,393; 3,858,626; 3,858,707; and, 4,487,132. While this type of conveying system is workable for straight-line motion of a pallet, the use of a rotating drive shaft precludes curvilinear motion of the pallet. In addition, independent movement of several pallets along the same shaft is not easily achieved using this type of system.

Some conveying systems are known which employ a rotating drive means in contact with a stationary rail. For example, U.S. Pat. No. 3,911,827 discloses such a device which employs two conical drive members, each of which contacts a speed regulating rail. However, this device suffers from the disadvantage that the speed regulating rails must be placed at differing distances from one another in order to regulate speed of the conveying system. Thus, this system is limited to a single-fixed design rather than being flexible for use at a variety of different speeds.

U.S. Pat. No. 4,023,503 also discloses a conveying system which employs drive wheels in contact with a stationary rail for driving the conveyor. While this trolley is capable of both straight and curvilinear motion, it requires a track which employs dual rails. This places some constraints on the amount of space that is required for the conveying system.

Accordingly, there is a need in the art for a conveying system which allows both straight and curvilinear motion of the pallet, independent movement of several pallets along the same track and which is small enough to fit into existing work spaces without taking up a great deal of space.

SUMMARY OF THE INVENTION

It is a goal of the present invention to provide a conveying means which is flexible enough to permit straight or curvilinear motion, as well as independent movement of several pallets along the same track.

This goal is realized by providing a conveying system which includes a track with pallets movable along the track. A stationary drive rail is mounted adjacent to the track and a drive roller mounted on the pallet is in contact with the drive rail. The drive roller is rotatable about a central axis and has a radial face engaging the drive rail. The pallet is propelled along the track by a motor mounted on the pallet which rotates the drive roller. Because the drive rail is stationary, the pallet is capable of motion along both straight and curvilinear tracks, unlike other conveying systems which use a rotating shaft and thus are limited to straight line motion.

In the preferred embodiment of the present invention, the motor includes dyno-break which permits controlled deceleration of the pallet in response to a signal from a control means which is associated with the pallet. Since each pallet is provided with an individual control means, each pallet can be driven separately from every other pallet employed in the conveying system. In addition, the pallet can be equipped with an object detector and with a proximity switch for providing more sophisticated control of the pallet.

Other features and advantages of the present invention will be readily apparent from the detailed description of the invention set forth hereinafter.

DETAILED DESCRIPTION OF THE PREFERRED EMBODIMENT

Figure 1:
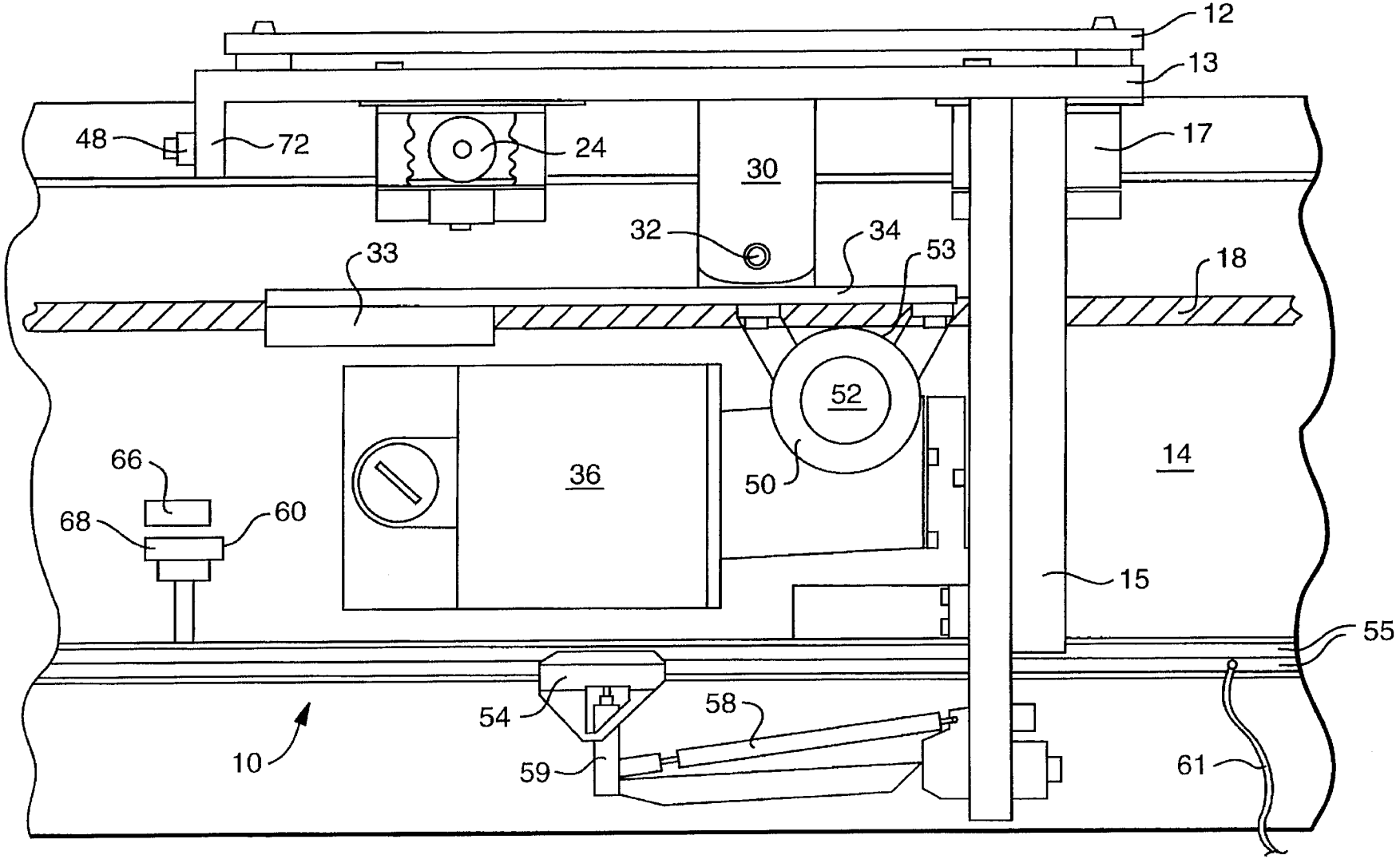
FIG. 1 is a side elevation view of a conveying system according to the present invention without the control means.
Figure 2:
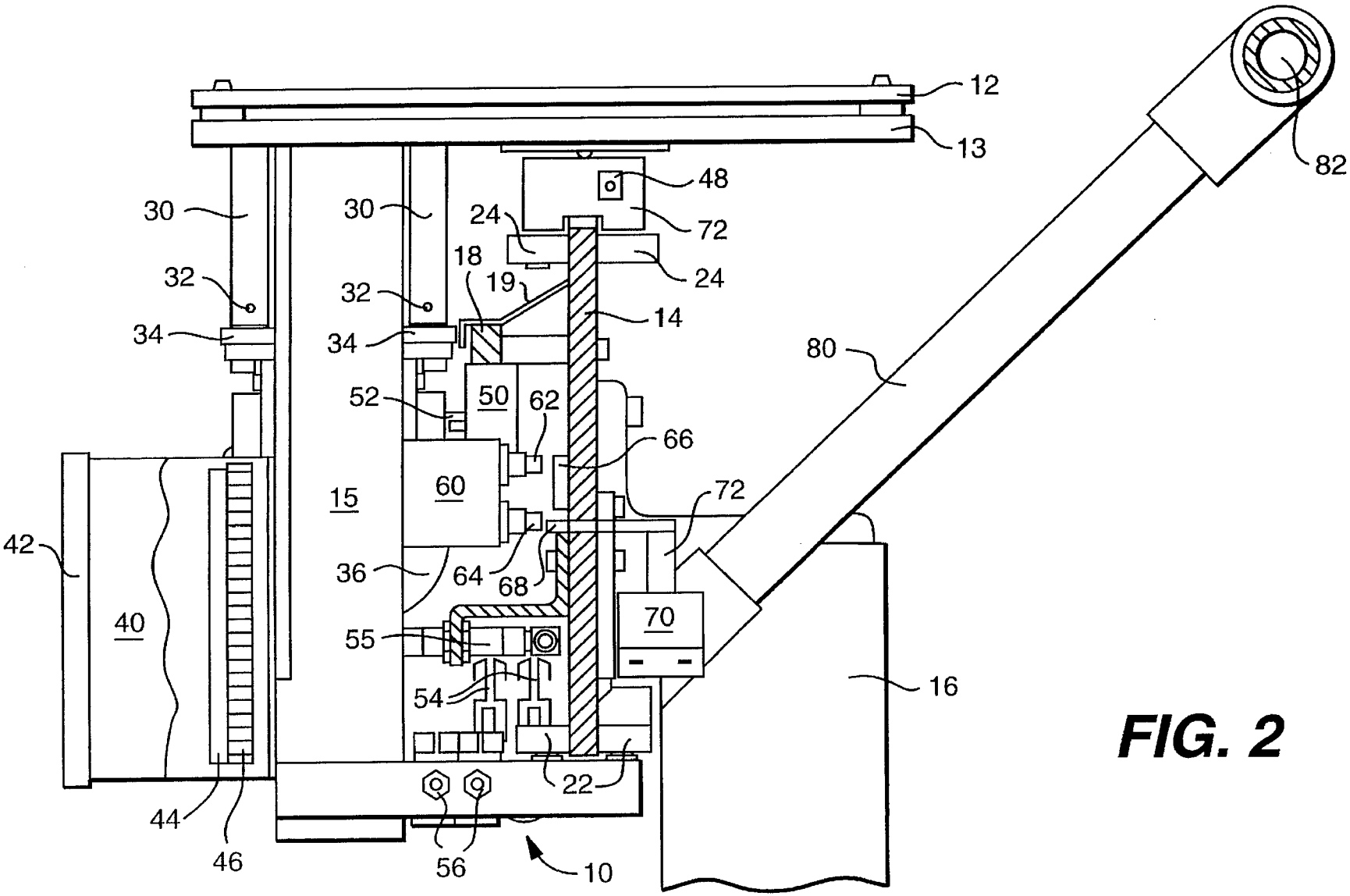
FIG. 2 is a front elevation view of a conveying system according to the present invention.

With reference to the drawings wherein like numerals refer to like elements throughout the several views, there is provided a conveying system 10 for moving pallets 12 along a track 14. Track 14 is supported by vertical support plates 16 as shown in FIG. 2. Track 14 may be in a straight line or curved in any desired pattern. Pallet 12 is supported on a plate 13 so that ready access is provided to any part of an article resting on pallet 12. Bracket 15 is secured to the bottom surface of plate 13. The lower end of bracket 15 has rotatably mounted thereon a pair of rollers 22 which engage opposite faces of the lower end of track 14. The upper end of bracket 15 has rotatably mounted thereon a pair of rollers (not shown) which are located inside roller housing 17 as shown in FIG. 1 which rollers engage the upper end of track 14. A pair of rollers 24 are rotatably mounted on plate 13 and engage the opposite faces of the upper end of track 14. The supporting structure of pallet 12 provides for a firm, relatively friction free ride on track 14.

Located on one side of track 14 is a drive rail 18 which is secured to track 14 by securing means 19. Drive rail 18 conforms to any curvature in the path of track 14. Drive rail 18 is rectangular as shown but may be of any desired shape provided that there is an outer surface adapted to engage the radial surface of a drive roller 50 as described hereinafter. Track 14 is supported by a series of support bars 80 which are connected to a support rail 82. Support rail 82 is affixed by supports (not shown) to the floor at periodic intervals. In this manner, track 14 is supported by a structure which does not interfere with the conveying system 10.

Mounted on the underside of plate 13 is a fixed brace 30. A pivot pin 32 is mounted in fixed brace 30. A motor 36 is mounted on pivot pin 32 via mounting means 34. Drive roller 50, which may be made of a metal or polyurethane material, is mounted on the drive shaft 52 of motor 36. A weight 33 retains the drive roller 50 with the radial surface 53 of the roller 50 held firmly against drive rail 18, preferably with less than 50 pounds of force. Motor 36 and drive roller 50 may be rotated about pivot 32 so as to disengage drive roller 50 from drive rail 18. Radial surface 53 of drive roller 50 may have a flat, convex or elliptical shape, or any other shape adapted to provide frictional contact between drive roller 50 and drive rail 18 to effectively propel pallet 12 along track 14.

Bus bar contacts 54 are slidably disposed within bus bar guides 55 affixed to track 14. Electrical energy is conducted from bus bar guide 55 through bus bar contacts 54 to motor 36 to provide energy for rotational motion of drive roller 50. Bus bar contacts 54 are affixed to mounting means 34 by any suitable means such as screws 56. The bus bar contacts 54 are preferably mounted on mounting means 34 via pivotable members 58–59 as shown in FIG. 1 which help bar contacts 54 follow curvilinear track sections. Bus bar contacts 54 are electrically connected to motor 36 for providing power thereto. Bus bar guides 55 are connected to a remote power source (not shown) by a power cable 61.

The conveying system 10 of the present invention also includes a control means which is shown in FIG. 2. The control means is housed in housing 40 shown in partial cross-section. Housing 40 has a removable cover 42 which provides easy access to the control means for repair and replacement. The control means typically comprises a circuit board 44 which plugs into a junction 46. In this manner, different circuit boards 44 can be employed to provide different types of control to the conveying system 10.

Also part of the control means is the object detector 48 which may be a camera or other known means for detecting an object. The object detector 48 is connected to junction 46 whereby the sensing of an object on track 14 ahead of pallet 12 will result in a signal from the control means to the drive motor 36 to stop drive motor 36. Optionally, an object detector 48 may also be mounted on the rear of the conveying system 10 for object detection when the conveying system 10 is moving in the reverse direction.

The conveying system 10 also includes a switch 60 which is connected to junction 46. Switch 60 is employed for stopping and starting the conveyor at particular locations along track 14. More particularly, switch 60 is preferably a proximity switch including top connection 62 and a bottom connection 64. In order to activate switch 60, there are mounted corresponding top activator 66 and bottom activator 68 on track 14. Bottom activator 68 on track 14 is adapted for movement upwardly and downwardly. This movement is accomplished by solenoid 70 attached to bottom activator 68 by a connector 72. When bottom activator 68 is in the upper position as shown in FIG. 2, the switch 60 is activated and a signal is sent via the control means to the drive motor 36 to stop the conveying system 10.

When it is desired to start the conveying system 10, solenoid 70 is activated to lower the bottom activator 68 out of proximity to bottom switch 64 in order to disrupt the transfer of electrical energy across the elements, thereby sending a signal via the control means to drive motor 36 to start the conveying system 10. Solenoid 70 may be actuated by any suitable means including a timing device (not shown), for example, or by a foot pedal (not shown).

In a preferred embodiment, drive motor 36 is a motor equipped with a dyno-brake which is employed to provide gradual deceleration of the conveying system 10 in order to avoid disturbing the cargo on pallet 12 when stopping.

The conveying system 10 may optionally include a deflector 72 mounted on the leading edge of plate 13 just above the track 14 for deflecting small foreign objects off track 14 in advance of the conveying system 10. Such a deflector 72 may also be employed on the other end of plate 13 (not shown) for deflecting foreign objects in advance of the conveying system 10 when it is moving in the reverse direction.

If it is desired to transport large objects using the conveying system 10, the front of a large pallet 12 may be connected to a first mounting means 34 which includes a drive motor 36 and the rear of the same large pallet 12 can be connected to a second mounting means 34 which includes rollers 22 for riding on track 14 but does not include a drive motor. In this manner, larger objects can be conveyed using the conveyor system 10. It is also possible to have three or four mounting means in tandem all connected to a single pallet 12. When employing two or more mounting means 34, pallet 12 must be pivotally connected to each mounting means 34 in order to allow the pallet to follow curvilinear track sections.

While the present invention has been described with respect to exemplary embodiments thereof, it will be understood by those of ordinary skill in the art that these and other variations and modifications can be effected within the scope and spirit of the invention. The scope of the invention is to be determined from the claims appended hereto.

What is claimed is:

1. A conveying system for moving an object along a path which may be straight or curvilinear, said conveying system comprising:

a pallet on which the object is conveyed;

a track by which said object is conveyed in a straight line or in curvilinear movement along said track;

mounting means attached to said pallet for mounting said pallet on said track;

bus bar guides mounted on said track;

a drive rail mounted on said track by securing means;

a drive motor;

drive roller mounted on a shaft of said drive motor and rotatable about an axis;

control means for controlling said drive motor, said control means, said drive roller and said drive motor being attached to said mounting meads such that a radial face of said drive roller contacts said drive rail to drive said pallet along said track by the rotation of said drive roller, said drive motor being mounted to said mounting means via a pivot, whereby said driver roller may be disengaged from said drive rail; and bus bars mounted on said mounting means in slidable engagement with said bus bar guides and electrically connected to said drive motor for providing electrical energy from said bus bar guides to said drive motor.

2. A conveying system as claimed in claim 1 wherein said mounting means includes a weight for urging said drive roller into contact with said drive rail.

3. A conveying system as claimed in claim 2 wherein said drive roller is urged into contact with said drive rail with less than 50 pounds of force.

4. A conveying system as claimed in claim 2 wherein said drive motor is capable of driving said drive roller in both a clockwise direction and a counter-clockwise direction to thereby provide forward and reverse motion of said pallet.

5. A conveying system as claimed in claim 2 wherein said drive motor comprises a braking means which permits controlled deceleration of said pallet.

6. A conveying system as claimed in claim 5 wherein said braking means comprises a dyno-brake.

7. A conveying system as claimed in claim 5 wherein said control means comprises an object detector mounted on the leading edge of said mounting means whereby said control means signals said drive means to stop in response to the detection of an object on said track ahead of said pallet.

8. A conveying system as claimed in claim 5 wherein said control means comprises a switch mounted on said mounting means, and said conveying system comprises at least one means for activating said switch mounted on said track at at least one predetermined location, said control means being capable of signaling said drive means to stop upon activation of said switch.

9. A conveying system as claimed in claim 8 wherein said switch is a proximity switch mounted on said mounting means in close proximity to said track.

10. A conveying system as claimed in claim 5 further comprising a deflector means mounted on the leading edge of said mounting means just above said track for deflecting small foreign objects off said track in advance of said pallet.

11. A conveying system as claimed in claim 5 wherein said drive motor is capable of driving said pallet at a speed of up to 200 feet per minute.

12. A conveying system as claimed in claim 1 wherein said mounting means further comprises rollers disposed between said pallet and said track.

13. A conveying system as claimed in claim 1 wherein said control means is mounted on said mounting means in a manner whereby said control means is easily accessible for repair or replacement.

* * * * *